US008118118B2

(12) United States Patent
Kruse et al.

(10) Patent No.: US 8,118,118 B2
(45) Date of Patent: Feb. 21, 2012

(54) MODULAR ROTARY DRILL HEAD

(75) Inventors: Christof Kruse, Wenden (DE); Stefan Wrede, Kirchhundem (DE); Hans-Juergen Wahl, Zella-Mehlis (DE)

(73) Assignee: Longyear TM, Inc., South Jordan, UT (US)

( * ) Notice: Subject to any disclaimer, the term of this patent is extended or adjusted under 35 U.S.C. 154(b) by 0 days.

(21) Appl. No.: 12/843,727

(22) Filed: Jul. 26, 2010

(65) Prior Publication Data

US 2010/0288560 A1 Nov. 18, 2010

Related U.S. Application Data

(63) Continuation of application No. 12/239,468, filed on Sep. 26, 2008, now Pat. No. 7,770,668.

(51) Int. Cl.
*E21B 3/02* (2006.01)

(52) U.S. Cl. ..... 175/170

(58) Field of Classification Search ..... 175/170, 175/171, 173, 189, 195; 173/152, 184; 74/665 D, 74/665 E See application file for complete search history.

(56) References Cited

U.S. PATENT DOCUMENTS

| | | | | |
|---|---|---|---|---|
| 2,904,287 | A | 10/1954 | Ertsgaard et al. | |
| 2,998,084 | A * | 8/1961 | Johnson et al. | 175/85 |
| 3,160,033 | A | 12/1964 | Moyer | |
| 3,212,589 | A | 10/1965 | Wink | |
| 3,286,556 | A | 11/1966 | Reynolds et al. | |
| 3,325,218 | A | 6/1967 | Kirkpatrick | |
| 3,467,202 | A | 9/1969 | Brown | |
| 3,528,510 | A | 9/1970 | Peterson | |
| 3,802,057 | A | 4/1974 | Porter | |
| 3,808,916 | A | 5/1974 | Porter et al. | |
| 3,835,940 | A | 9/1974 | Winter, Jr. | |
| 3,912,021 | A | 10/1975 | Cloup | |
| 4,314,611 | A * | 2/1982 | Willis | 173/197 |
| 4,371,041 | A | 2/1983 | Becker et al. | |
| 4,457,677 | A * | 7/1984 | Todd | 418/61.3 |
| 4,570,706 | A | 2/1986 | Pugnet | |
| 4,609,053 | A | 9/1986 | Ragnmark | |
| 4,632,194 | A | 12/1986 | Averill | |
| 4,971,158 | A | 11/1990 | Salmi | |
| 5,409,070 | A * | 4/1995 | Roussy | 173/49 |

(Continued)

FOREIGN PATENT DOCUMENTS

DE 3315307 A1 10/1984

(Continued)

OTHER PUBLICATIONS

Hsai-Yang Fang, Foundation Engineering Handbook, Published 1991, Springer, 924 pages. Discussion: p. 24, section 1.8.10 discusses rotary drilling, drill rods, drill heads, rotary drive mechanisms, and hollow spindles.

(Continued)

*Primary Examiner* — Jennifer H Gay
*Assistant Examiner* — Blake Michener
(74) *Attorney, Agent, or Firm* — Workman Nydegger

(57) ABSTRACT

A modular base assembly for a rotary drill head includes a drive flange assembly having a tubular drive shaft configured to engage at least a lower drive interface. The modular base assembly also includes a gear housing supporting the drive flange assembly. Furthermore, the modular base assembly can also include a plurality of interchangeable gear pinions selectively coupled to the drive flange assembly.

20 Claims, 7 Drawing Sheets

U.S. PATENT DOCUMENTS

| | | | | |
|---|---|---|---|---|
| 5,431,234 | A | 7/1995 | Klemm | |
| 5,433,279 | A * | 7/1995 | Tessari et al. | 173/213 |
| 5,516,268 | A | 5/1996 | Kassen et al. | |
| 5,561,645 | A | 10/1996 | Eastman et al. | |
| 5,803,189 | A | 9/1998 | Geldner | |
| 5,836,727 | A | 11/1998 | Scheer | |
| 5,954,346 | A | 9/1999 | McLaren | |
| 6,263,985 | B1 | 7/2001 | Scheid et al. | |
| 6,719,303 | B2 | 4/2004 | Stephens | |
| 2001/0050168 | A1 | 12/2001 | Hult | |
| 2002/0197174 | A1 | 12/2002 | Howard | |
| 2003/0050168 | A1 | 3/2003 | Neubauer et al. | |
| 2005/0189146 | A1 * | 9/2005 | Oglesby | 175/107 |
| 2005/0279507 | A1 | 12/2005 | Folk et al. | |
| 2007/0172165 | A1 * | 7/2007 | Moller et al. | 384/494 |
| 2007/0251699 | A1 * | 11/2007 | Wells et al. | 166/377 |
| 2008/0000692 | A1 | 1/2008 | Roussy | |
| 2009/0044982 | A1 | 2/2009 | Wells et al. | |
| 2009/0166090 | A1 | 7/2009 | Rudshaug et al. | |

FOREIGN PATENT DOCUMENTS

| | | | |
|---|---|---|---|
| DE | 3411889 | C1 | 9/1985 |
| DE | 3723819 | A1 | 1/1989 |
| DE | 3802443 | C1 | 3/1989 |
| DE | 3904631 | A1 | 8/1990 |
| DE | 3922776 | A1 | 1/1991 |
| DE | 19512109 | A1 | 10/1996 |
| DE | 10134000 | A1 | 1/2003 |
| DE | 202004015257 | U1 | 6/2005 |
| DE | 202005008630 | U1 | 10/2005 |
| DE | 202007001858 | U1 | 5/2007 |
| EP | 1632637 | A1 | 3/2006 |
| ES | 2051613 | A1 | 6/1994 |
| GB | 337834 | A | 11/1930 |
| GB | 1603608 | A | 11/1981 |
| GB | 2273120 | A | 6/1994 |
| JP | 2001-123783 | A1 | 5/2001 |
| WO | 2007-064232 | | 6/2007 |

OTHER PUBLICATIONS

Simco Drilling Equipment, Inc., 2800 HS(HT) Wet Rotary Drill, Excerpt: "Hydraulic Drive, Hollow Spindle Drill Head"-Single speed torque range (2840 ft. lbs. max/0-185 RPM0. Has a 2" ID hollow spindle. [online] [retrieved on Oct. 8, 2008], 3 pgs. Retrieved from the Internet: http://www.simcodrill.com/2800wet.html.

Novamac Eurasia, Excerpt:Drill Head: Novamac 6000; Two speeds hollow spindle rotary drive, variable/reversible hydraulic motor; 1st gear: Max torque 7500 LBF-ft (10170Nm) at 5000psig (345bar) max speed 250rpm; 2nd gear: Max torque 1300 LBF-ft (1763 Nm) at 5000psig (345bar) max speed 1500rpm; Floating spindle for RC and DTH drilling. [online] [retrieved on Oct. 8, 2008], 3 pgs. Retrieved from the Internet:http://novamac-eurasia.ecocity-group.com/ET642-RC.html.

Hydraulic Drilling & Investigation Rigs. Excerpt: "Beretta T21; The Rotary drill head has a modular structure and by superimposing 1-2 or 3 hydraulic motors, it is possible to select various rpm and torque." [online] [retrieved on Oct. 8, 2008], 1 pg. Retrieved from the Internet http://www.airfluidotago.com/beretta.html.

* cited by examiner

MODULAR ROTARY DRILL HEAD

CROSS-REFERENCE TO RELATED APPLICATIONS

This patent application is a continuation application of U.S. patent application Ser. No. 12/239,468, filed on Sep. 26, 2008, entitled "Modular Rotary Drill Head." The contents of each of the above-referenced application are hereby incorporated by reference in their entirety.

BACKGROUND OF THE INVENTION

1. The Field of the Invention

The present invention relates to drill heads and to rotary drill heads in particular.

2. The Relevant Technology

Drilling rigs are often used for drilling holes into various substrates. Such drill rigs often include a drill head mounted to a generally vertically oriented mast. The rig often includes mechanisms and devices that are capable of moving the drill head along at least a portion of the mast. The drill head often further includes mechanisms that receive and engage the upper end of a drill rod or pipe. The drill rod or pipe may be a single rod or pipe or may be part of a drill string that includes a cutting bit or other device on the opposing end, which may be referred to as a bit end.

The drill head also applies a force to the drill rod or pipe which is transmitted to the drill string. If the applied force is a rotational force, the drill head may thereby cause the drill string rotate within the bore hole. The rotation of the drill string may include the corresponding rotation of the cutting bit, which in turn may result in cutting action by the drill bit. The forces applied by the drill head may also include an axial force, which may be transmitted to the drill string to facilitate penetration into the formation.

In many instances, specialized drill heads are utilized for differing applications. As a result when conditions change, a different drill head if not an entirely different drill rig is used, thereby increasing capital costs and/or down time.

The subject matter claimed herein is not limited to embodiments that solve any disadvantages or that operate only in environments such as those described above. Rather, this background is only provided to illustrate one exemplary technology area where some embodiments described herein may be practiced.

BRIEF SUMMARY OF THE INVENTION

A modular base assembly for a rotary drill head can include a drive flange assembly having a tubular drive shaft configured to engage at least a lower drive interface, a gear housing supporting the drive flange assembly, and a plurality of interchangeable gear pinions selectively coupled to the drive flange assembly.

A modular rotary drill head system can include a modular base assembly having a drive flange assembly having a tubular drive shaft configured to engage at least a lower drive interface, and a gear housing supporting the drive flange assembly, a plurality of drive motor assemblies, and a plurality of interchangeable gear pinions coupled to the drive motor assemblies, the gear pinions being configured to be interchangeably coupled to the gear housing.

A drilling system can include a sled assembly having a modular rotary drill head system, that includes a modular base assembly including a drive flange assembly having a tubular drive shaft configured to engage at least a lower drive interface, a gear housing supporting the drive flange assembly, a plurality of drive motor assemblies, and a plurality of interchangeable gear pinions coupled to the drive motor assemblies, the gear pinions being configured to be interchangeably coupled to the gear housing.

This Summary is provided to introduce a selection of concepts in a simplified form that are further described below in the Detailed Description. This Summary is not intended to identify key features or essential characteristics of the claimed subject matter, nor is it intended to be used as an aid in determining the scope of the claimed subject matter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

Figure 1:
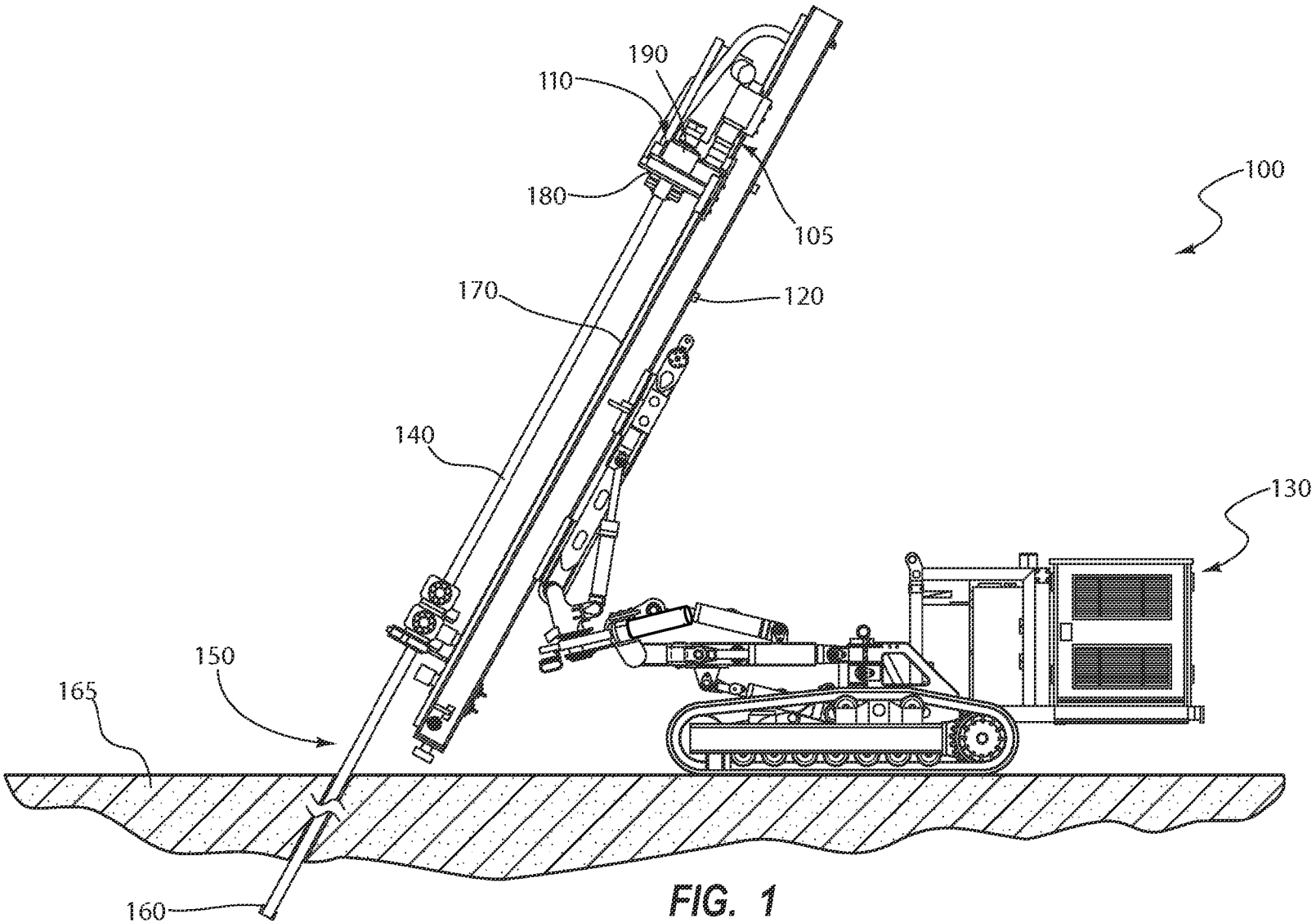
FIG. 1 illustrates a drilling system having a modular rotary drill head according to one example.

Together with the following description, the Figs. demonstrate non-limiting features of exemplary devices and methods. The thickness and configuration of components can be exaggerated in the Figures for clarity. The same reference numerals in different drawings represent similar, though not necessarily identical, elements.

DETAILED DESCRIPTION OF THE PREFERRED EMBODIMENTS

In at least one example, a modular rotary drill head includes a modular base assembly that includes a gear housing and a large diameter, hollow drive shaft. The gear housing can include interchangeable gear wheels and drive pinions that are configured to drive the drive shaft. Such a configuration may allow the drill head to operate with different drive motors, thereby allowing for interchangeability of drive motors on a single rotary drill head. The ability to interchange driver motors can allow the drill head to operate over a wide range of torques and/or rotational speeds.

Further, the configuration of the drive shaft may further allow the modular rotary drill head to operate in a variety of conditions. For example, the head may be used in deep hole drilling, such as Geothermal drilling, as the large diameter shaft and axial bearings are able to withstand large axial loads.

The modular rotary drill head can be configured to allow the gear housing to float as the modular rotary drill threads and/or unthreads tubular threaded members, such as drill rods and casing. Such a configuration can allow the gear housing to move during the unscrewing and screwing process of the rods and casings, which can reduce the stresses on the threaded portion of the tubular threaded members. Reducing the stresses on the threaded portions can in turn result in less wear on the threads. As used herein, the terms bottom, lower, and below will be used to describe a portion of a component or system that is located toward the bit end of the system while top, upper, and above will be used to describe a component or system that is located on an opposing side of the system or component.

FIG. 1 illustrates a drilling system 100 that includes a sled assembly 105 and a drill head 110. The sled assembly 105 can be coupled to a mast 120 that in turn is coupled to a drill rig 130. The drill head 110 is configured to have one or more tubular threaded member 140 coupled thereto. Tubular threaded members can include, without limitation, drill rods and rod casings. For ease of reference, the tubular threaded member 140 will be described as a drill rod. The drill rod 140 can in turn be coupled to additional drill rods to form a drill string 150. In turn, the drill string 150 can be coupled to a drill bit 160 or other down-hole tool configured to interface with the material to be drilled, such as a formation 165.

In at least one example, the drill head 110 illustrated in FIG. 1 is configured to rotate the drill string 150 during a drilling process. In particular, the drill head 110 may vary the speed at which the drill head 110 rotates. In particular, the rotational rate of the drill head and/or the torque the drill head 110 transmits to the drill string 150 may be selected as desired according to the drilling process. For example, the drive motors, pinions, and/or gear wheels may be interchanged to provide the rotational rate and/or torque desired to suit different drilling applications.

Further, the sled assembly 105 can be configured to translate relative to the mast 120 to apply an axial force to the drill head 110 to urge the drill bit 160 into the formation 165 during a drilling operation. In the illustrated example, the drilling system 100 includes a chain-drive assembly 170 that is configured to move the sled assembly 105 relative to the mast 120 to apply the axial force to the drill bit 160 as described above. As will be discussed in more detail below, the drill head 110 is can be configured in a number of ways to suit various drilling conditions.

In at least one example, the drill head 110 is coupled to drill rod 140 by way of interchangeable interface 180. The interchangeable interface 180 in turn can be operatively associated with a drive flange assembly (not shown), which in turn can be driven by a drive shaft 190. The drive shaft 190 can have a relatively large diameter inner bore. Such a configuration may allow the drive shaft 190 to transfer high-torque loads. Further, such a configuration may accommodate a large range of additional drill components, such as second drive heads and/or other components.

One basic configuration of a rotary drill head system will first be described in which one exemplary set of components have been assembled to a modular base assembly. The functionality of the rotary drill head system in such a configuration will then be described, followed by a description of interchanging various components.

Figure 2A:
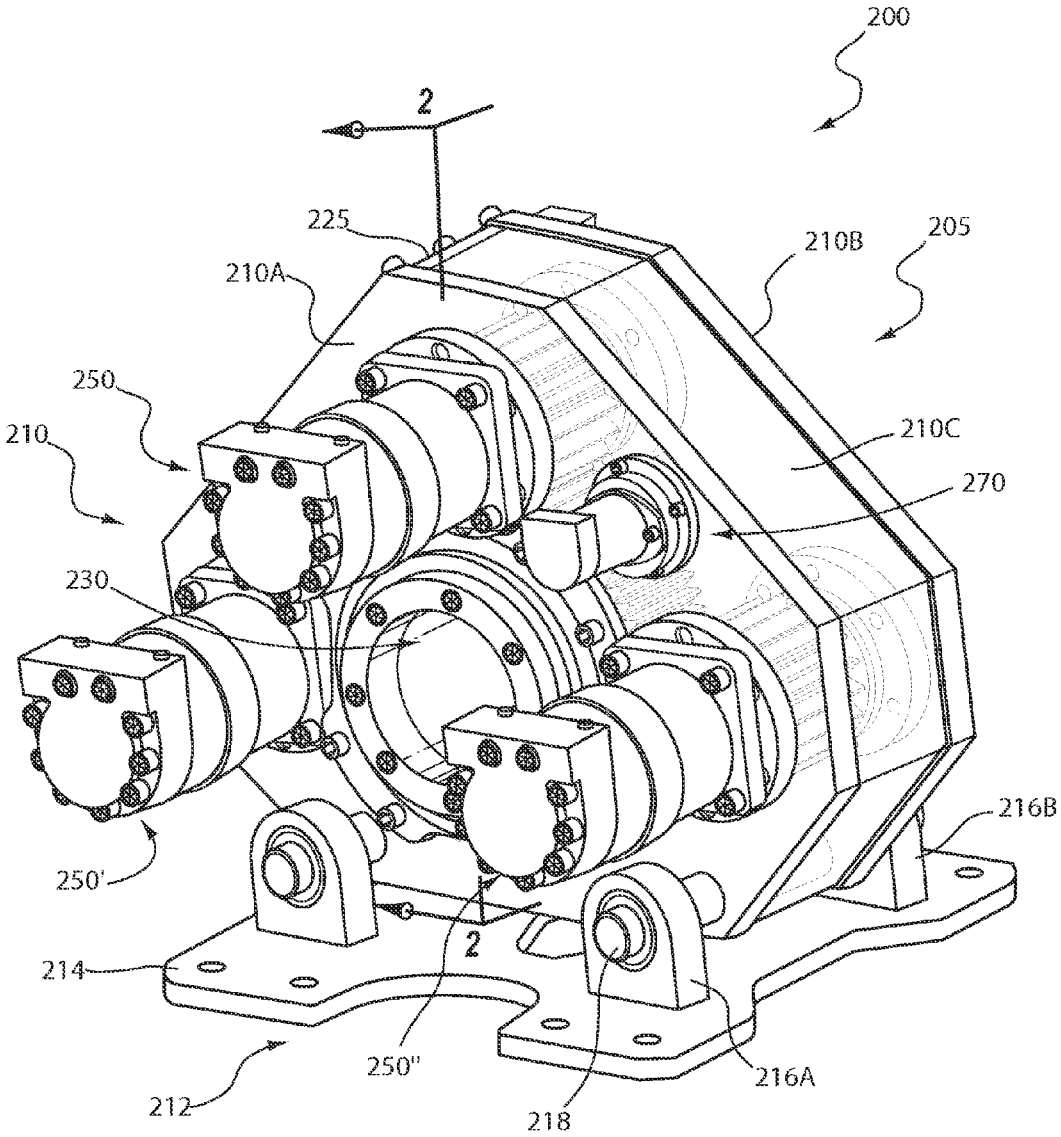
FIG. 2A illustrates a perspective view of a modular rotary drill head according to one example.

As illustrated in FIG. 2A, a rotary drill head system 200 includes a modular base assembly 205. The modular base assembly 205 includes a gear housing 210 that supports a drive flange assembly 230. The gear housing 210 is configured to provide a base to which one or more drive motor assemblies, such as drive motor assemblies 250, 250', and 250" (not shown), can be interchangeably coupled. As will be described in more detail below, the drive motor assemblies 250, 250', 250" may be exchanged in groups, such that the drive motor assemblies 250, 250', 250" can be exchanged as a group for additional drive motor assemblies. The drive motor assemblies 250, 250', and 250" are operatively associated with the drive flange assembly 230 to provide motive force to rotate a drill rod or other components. Further, in at least one example, the modular base assembly 205, and the gear housing 210 in particular, is configured to provide thread compensation to reduce wear associated with threading and/or unthreading drill rods from the rotary drill head system.

The gear housing 210 can be operatively associated with a sled mount assembly 212. The sled mount assembly 212 includes a base 214 having at least one upper tab 216A and at least one lower tab 216B. The upper tab 216A and lower tab 216B shown extend away from the base 214. One or more rails 218 extend at least partially between the upper and lower tabs 216A, 216B. In at least one example, the rails 218 pass through the gear housing 210. Further, at least a portion of the gear housing 210 is located between the upper and lower tabs 216A, 216B.

The rails 218 constrain the gear housing 210 from rotating relative to an axis generally parallel to the base 214 while the upper and lower tabs 216A, 216B bound the axial movement of the gear housing 210. As will be discussed in more detail with reference to the functionality of the rotary drill head system 200, floating the entire gear housing 210 can allow the rotary drill head system 200 to translate to reduce thread wear associated with coupling/decoupling a threaded rod tubular member from the rotary drill head system 200 by rotating the drive flange assembly 230 with the drive motor assemblies 250.

Additionally, the drive flange assembly 230 is configured to have additional components interchangeably secured thereto. These components can include components located above and/or below the drive flange assembly 230. The drill head assembly 200 may also include an optional lubrication assembly 270 associated with the modular base assembly 205.

In the illustrated example, the gear housing 210 generally includes a top portion 210A, a bottom portion 210B, and a peripheral portion 210C generally defining a compartment. The gear housing 210 can further include an access cover 225 removably coupled to the peripheral portion 210C. Such a configuration may provide ready access to the compartment and the components positioned therein.

Figure 2B:
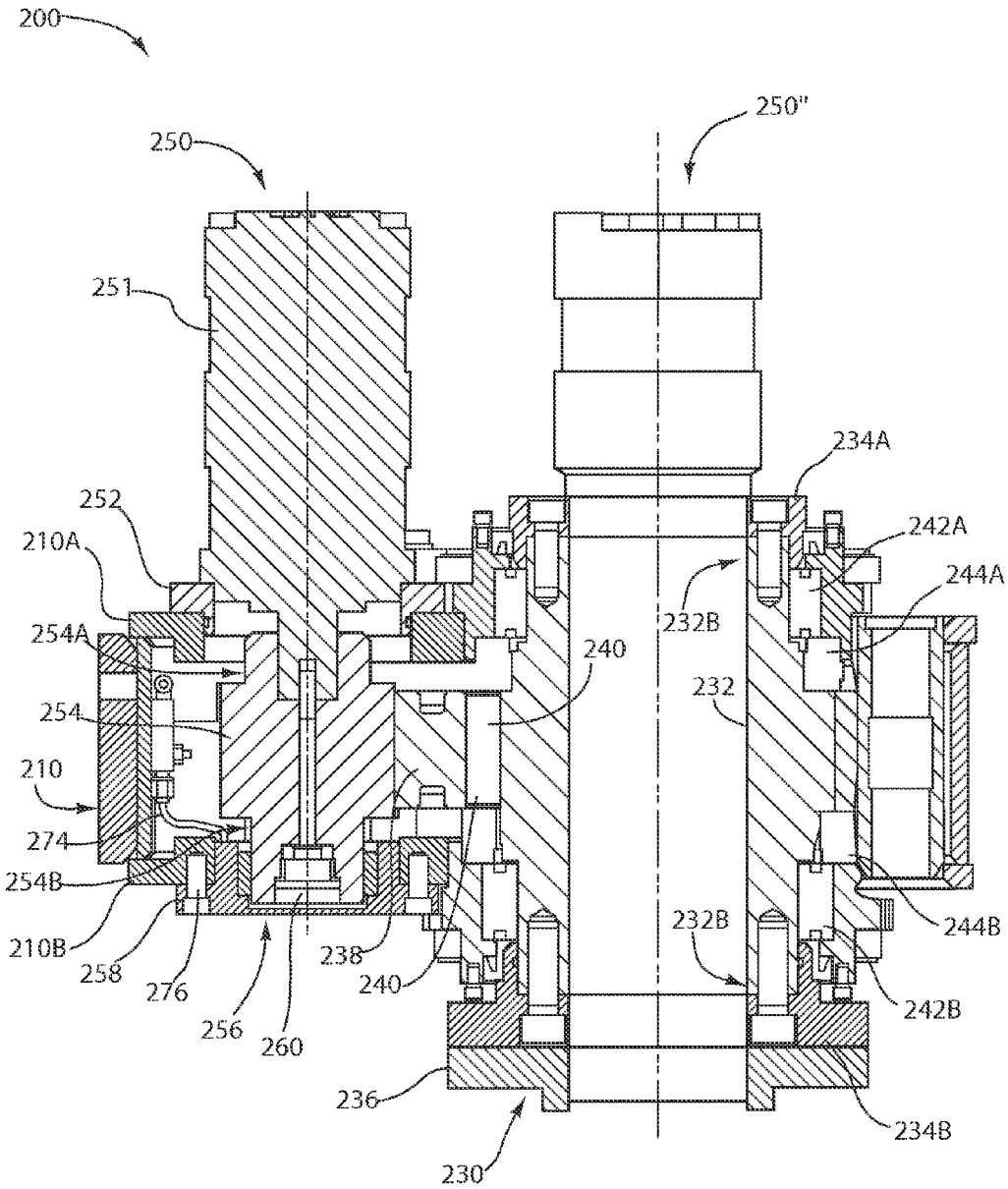
FIG. 2B illustrates a cross-sectional view of the modular rotary drill head taken along section 2-2 of FIG. 2A.

FIG. 2B illustrates a cross-sectional view of the modular rotary drill head system 200 taken along section 2B-2B of FIG. 2A. As shown, at least part of the drive flange assembly 230 can be located at least partially within the compartment. The drive flange assembly 230 can include a drive shaft 232 having an upper portion 232A and a lower portion 232B. In at least one example, the drive shaft 232 has an inner diameter up to about 12 cm or larger. An upper flange mount 234A may be secured to the top portion 232A while a lower flange mount 234B may be secured to the lower portion 232B. A driving flange 236 is shown secured to the lower portion 232B.

Figure 2C:
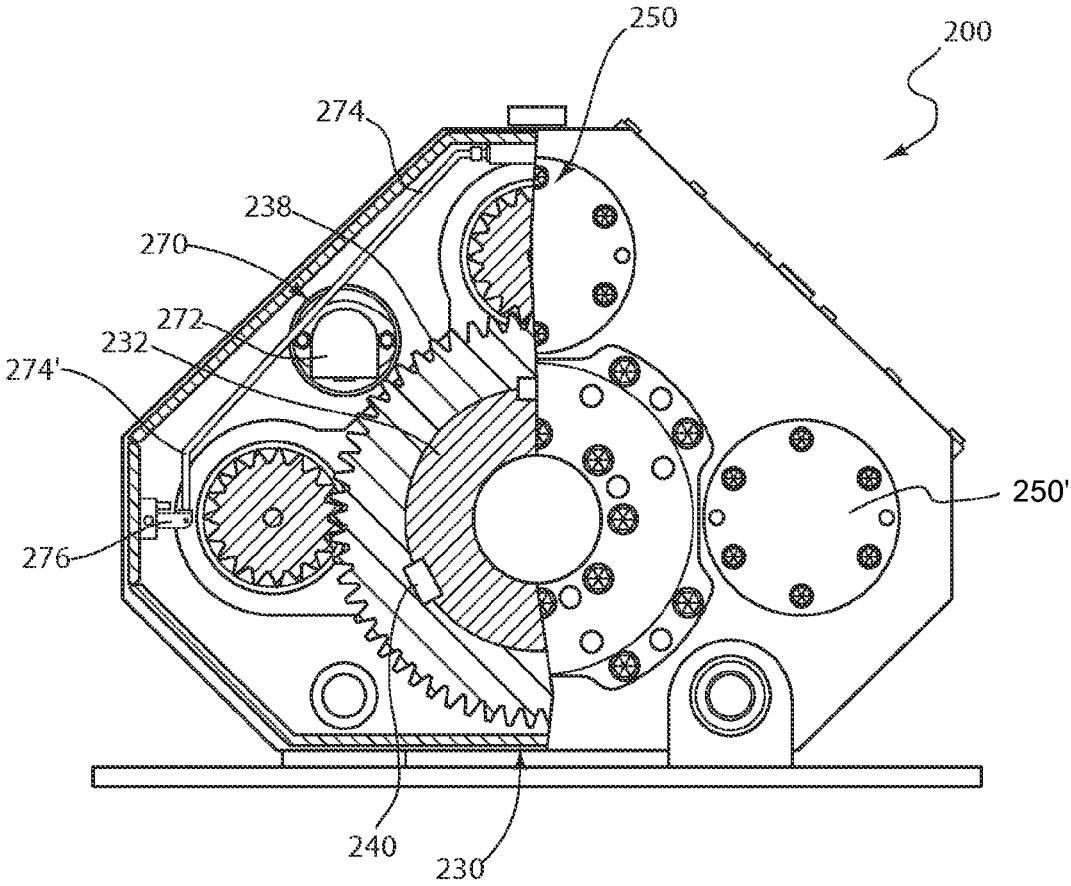
FIG. 2C illustrates a plan view of the modular rotary drill head of FIG. 2A.

FIG. 2C illustrates a plan view of the modular rotary drill head system 200 in which part of the top portion 210A of the gear housing 210 has been removed for ease of reference. As illustrated in FIG. 2C, the drive shaft assembly 230 can also include a gear wheel 238 secured to the drive shaft 232 in any suitable manner. For example, the gear wheel 238 may be secured to the drive shaft 232 by one or more keys 240.

As illustrated in FIG. 2B, the drive shaft 232 can be supported within the gear housing 210 by one or more bearings. In particular, the drive shaft 232 may be supported by upper and lower needle bearings 242A, 242B and/or upper and lower axial bearings 244A, 244B, such as axial-cylinder roller bearings. Such a bearing configuration may allow the rotary drill head system 200 to withstand the high axial forces associated with operating a heavy drill string at great depths.

As previously introduced, the drive shaft assembly 232 is operatively associated with one or more drive motor assemblies 250, 250" and 250' (FIG. 2A). In the illustrated example, each of the drive motor assemblies 250, 250', 250" are substantially similar. In other examples, modular rotary drill head systems may include drive motor assemblies with different configurations. For ease of reference, similar drive motor assemblies 250, 250', 250" will be described relative to a drive motor assembly 250. It will be appreciate that the description may also be applied to drive motor assemblies 250' and 250".

Continuing with reference to FIGS. 2B and 2C, the drive motor assembly 250 can include a drive motor 251. The drive motor 251 can be coupled to the gear housing 210 by a housing flange 252. The drive motor 251 is further operatively associated with a gear pinion 254. The gear pinion 254 is supported on a top portion 254A by the drive motor 251 and on a bottom portion 254B by a bearing assembly 256.

In the illustrated example, the bearing assembly 256 includes a flange mount 258 that configured to be secured to a bottom portion 210B of the gear housing 210. The bearing assembly 256 further includes a bearing 260, such as a radial bearing, that is operatively associated with the flange mount 258. The bearing 260 provides rotating support for the gear pinion 254 as the gear pinion 254 is driven by the drive motor 251.

As previously introduced, the drive motor assembly 250 is configured to be interchangeably coupled to the drive shaft assembly 230. In the illustrated example, when the drive motor assembly 250 is assembled to the gear housing 210, the gear pinion 254 engages the gear wheel 238. As a result, when the drive motor 251 is actuated to drive the gear pinion 254, the gear pinion 254 drives the gear wheel 238. The gear wheel 238 in turn is secured to the drive shaft 232 such as gear wheel 238 rotates it turns the drive shaft 232.

As also illustrated in FIGS. 2B and 2C, the modular rotary drill head system 200 can include a lubrication assembly 270 that is configured to lubricate one or more of the bearings 260 and/or other bearings described above. In the illustrated example, the lubrication assembly 270 generally includes a lubrication pump 272 that distributes lubricant through a series of conduits 274, 274'. For ease of reference, conduit 274 will be discussed as providing lubrication to bearing 260. It will be appreciated that this discussion can be equally applicable to the lubrication of the other bearings.

Continuing with reference to FIGS. 2B and 2C, the conduits 274 can be operatively associated with an outlet 276 that is positioned in proximity to the bearing 260. As a result, the lubrication pump 272 can pump lubricant through the conduits 274 and outlet 276 onto the bearing 260. The lubrication assembly 270 can be configured to lubricate bearings, such as bearings 260, as the rotary drill head system 200 operates, thereby reducing down-time associated with manually lubricating bearings.

Figure 3:
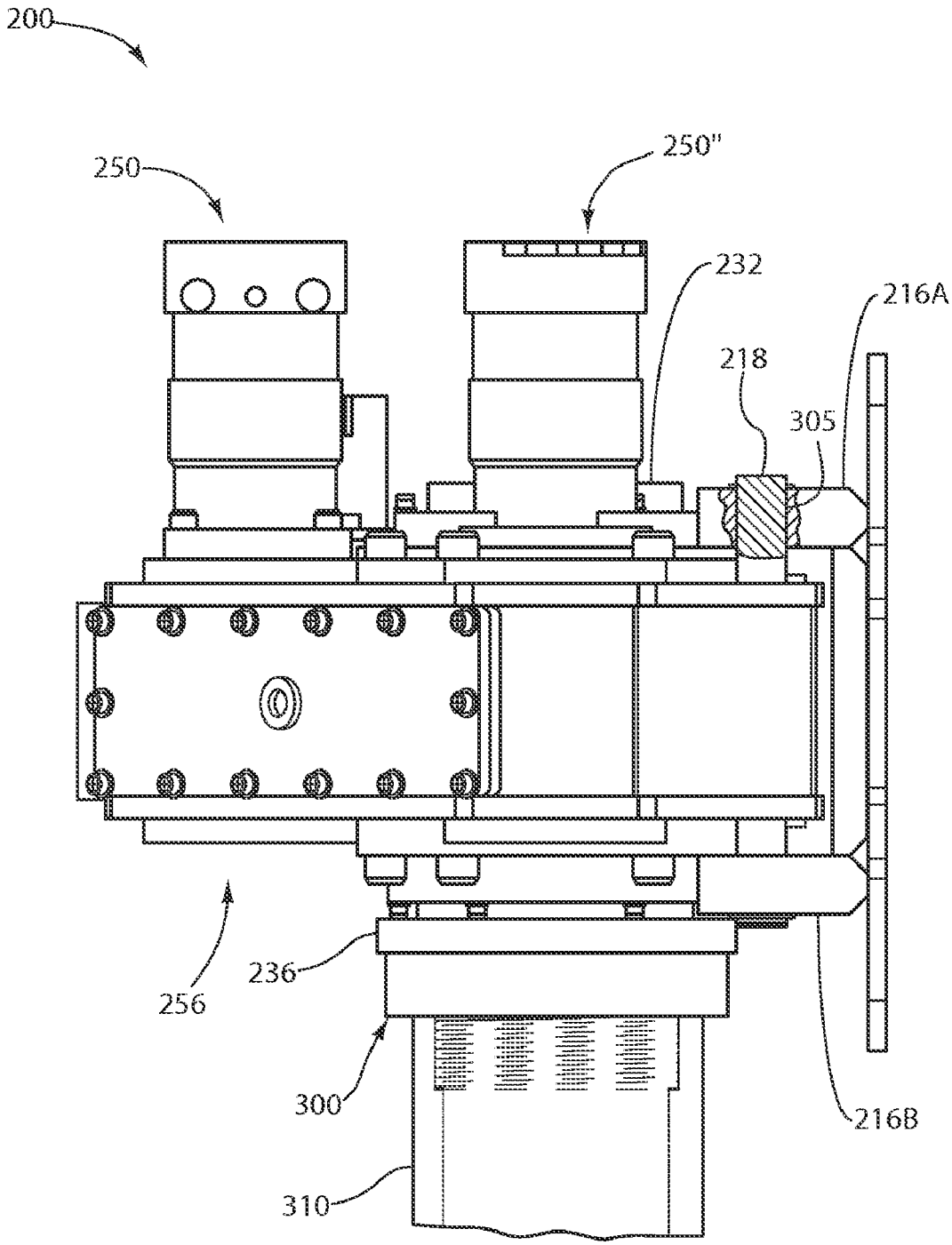
FIG. 3 illustrates an elevation view of a modular rotary drill head system according to one example.

To this point, a rotary drill head system 200 has been illustrated and described that includes an exemplary set of drive motor assemblies 250, 250', 250" coupled to the modular base assembly 205. FIG. 3 illustrates additional components secured below the drive flange assembly 230. In the illustrated example, a drill rod interface 300 is shown coupled to the driving flange 236. The drill rod interface 300 can be a threaded, pin-type interface that is configured to rotate into and out of engagement with a corresponding box-end of a drill rod 310.

As previously introduced, the gear housing 210 is configured to float relative to the sled mount assembly 212. In particular, as illustrated in FIG. 3, one or more bushings 305 may be positioned within the gear housing 210 to support and guide the gear housing 210 on the rails 218 as the gear housing 210 translates relative to the rails 218. Such a configuration allows the rotary drill head system 200 to float while threading and unthreading the drill rod 310 from the drill rod interface 300. In particular, in the illustrated example, while drilling a formation and/or tripping a drill rod 310 downward, an upper portion 210A of the gear housing 210 contacts the upper tab 216A. Similarly, while lifting a drill rod 310, the lower portion 210B of the gear housing 210 contacts the lower tab 216B.

Accordingly, as a drill rod 310 is raised and gripped to allow the drill rod interface 300 to rotate relative to the drill rod 310 the lower portion 210B of the gear housing 210 is often in contact with or located proximate to the lower tab 216B. As the rotary drill head system 200 rotates the drill flange 300 to unthread the drill rod 310. Unthreading the drill rod 310 from the drill rod interface results in relative separation between the drill rod interface 300 and the drill rod 310. As previously introduced, the gear housing 210 is configured to freely translate relative to the sled mount assembly 212. This movement may be referred to as thread compensation. Accordingly, as the drill rod 310 is thus unthreaded from the drill rod interface 300, the rotary drill head system 200 is able to move away from the drill rod 310 thereby reducing localized stresses on the threads of the drill rod 310 and the drill rod interface 300.

While a drill rod interface 300 is shown as being coupled to the driving flange 236, it will be appreciated that other components and/or systems may also be coupled to the driving flange 236. For example, the driving flange 236 may be configured to receive other drilling equipment that can include, but is not limited to, a flushing head, a preventer, chuck, an ejection bell, and/or other drilling equipment by coupling a corresponding flange to the drilling equipment and then coupling that flange to the driving flange 236. Further, the upper flange mount 234A can be configured to have any number of drill components secured thereto in a similar manner. These components can include, without limitation, a central flushing head, a packing box, a RC flushing head, and/or other drilling equipment.

As previously introduced, the rotary drill head system 200 is configured to float relative to the sled mount assembly 212. Such a configuration can provide thread compensation while at the same time allowing the drive shaft 232 to have both a large outer diameter as well as a relatively large inner diameter. A relatively large inner diameter may provide additional functionality for the rotary drill head system 200. In particular, the relatively large inner diameter may allow relatively larger components, such as those used in double drilling or other similar operations, to pass through the drive shaft 232. For example, double head drilling, jet grouting, RC-Drilling and/or other similar operations may be performed by combining an additional drill head or a drifter head on the same mast and/or sled assembly, as illustrated in FIG. 4, represented schematically as second drill head 400 in FIG. 4.

Figure 4:
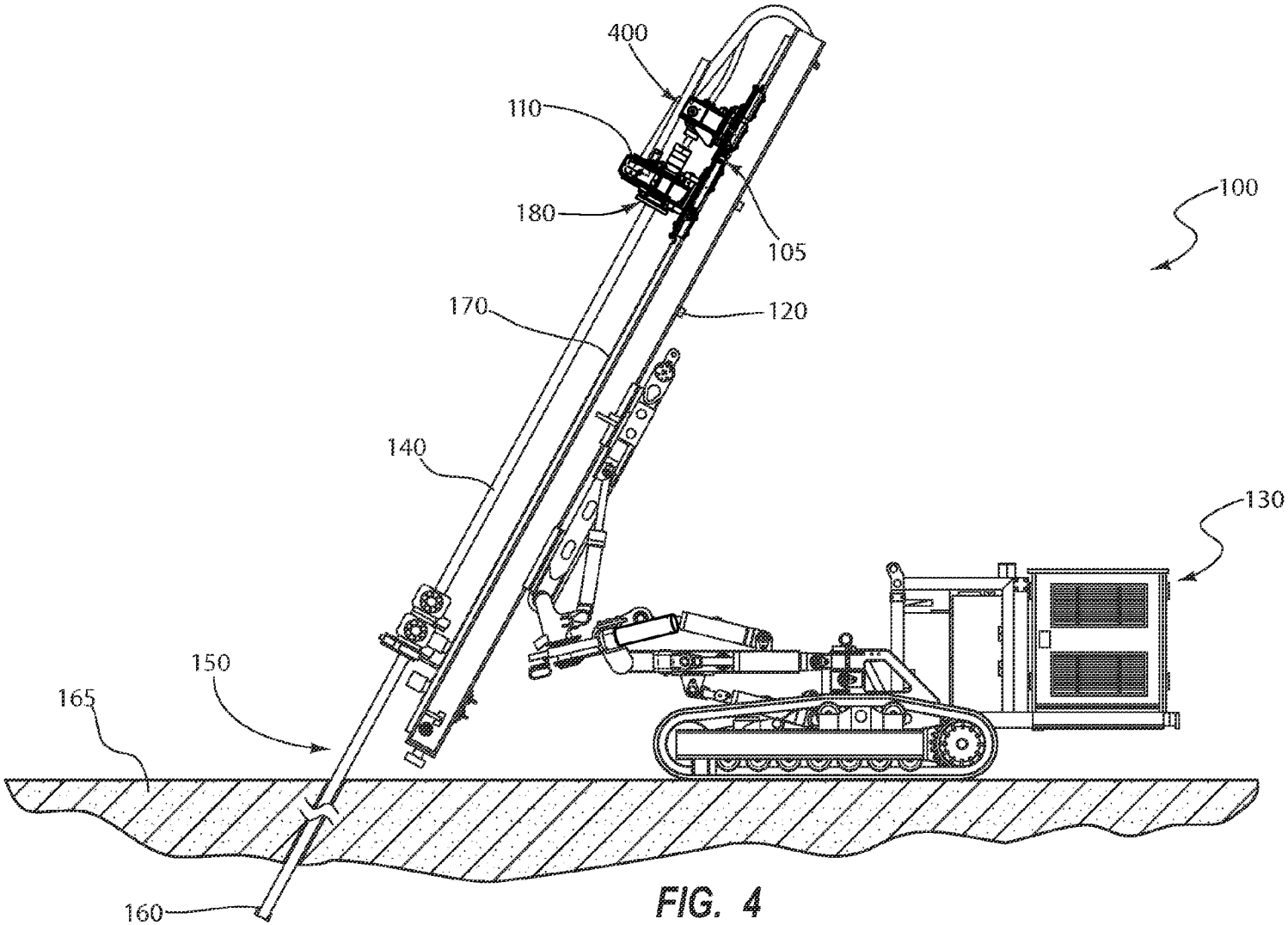
FIG. 4 illustrates a double-head drilling system according to one example.

While one type of double head drilling configuration is illustrated in FIG. 4, it will be appreciated that other types of double head configurations can be readily coupled to the modular base assembly 205. Further, it will be appreciated that several modular base assemblies 205 can be combined as desired to perform double drilling operations. Each of these configurations can be assembled to a single modular base assembly 205 by interchanging components as desired for a particular application. Accordingly, the modular base assembly 205 is configured to have additional components coupled thereto from both above and below.

Figure 5:
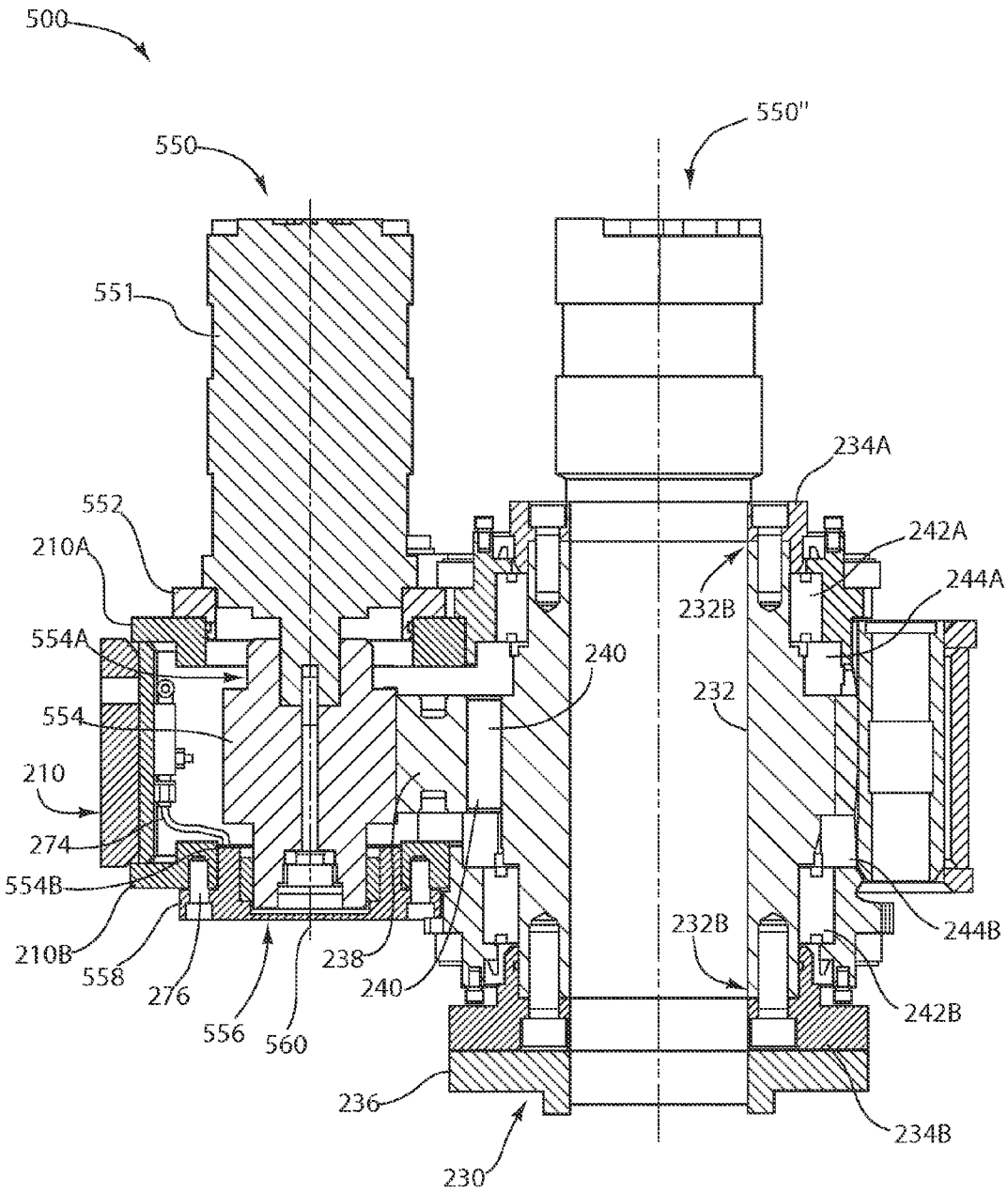
FIG. 5 illustrates modular rotary drill head of FIG. 2A-2C in which the drive motors have been interchanged.

Further, the modular base assembly 205 is configured to have any number of drive motor assemblies coupled thereto. As previously discussed and as illustrated in FIGS. 2B and 2C, the modular base assembly 205 includes a gear housing 210 to which drive motor assemblies 250, 250', 250" can be coupled. As illustrated in FIG. 5, drive motor assemblies 550, 550', 550" can be exchanged for drive motor assemblies 250, 250', 250". In particular, referring again briefly to FIGS. 2B and 2C, drive motor assemblies 250, 250', 250" may be removed by decoupling the housing flange 252 from the upper portion 210A of the gear housing 210 and decoupling the bearing assembly 256 from the bottom portion 210B of the gear housing 210.

Thereafter, referring again to FIG. 5, bearing assemblies 556 can then be secured modular base assembly 205 by securing the flange mount 558 to the corresponding bottom portion 210B of the gear housing 210. The flange mount 558 is configured to locate bearing 560 and the associated gear pinion 554 such that the gear pinion 554 engages the gear wheel 238. The gear pinion 552 can be positioned relative to the bearing before or as the housing flange 552 with the drive motor 551 is secured to the upper portion 210A of the gear housing. The drive motor 551 and/or the gear pinion 552 may provide different rotational and/or torque performance ranges relative to those associated with drive motor assembly 250.

Further, any number of additional drive motor assemblies may be interchanged with the modular base assembly 205 that include any number of different rotational and/or torque ranges. Accordingly, the rotary drill head system 200 can be readily configured to provide torque and/or rotational performance as desired by interchanging drive motor assemblies with the modular base assembly 205. Further, interchanging drive motor assemblies can be performed as desired while the modular base assembly 205 remains coupled to a drill mast. In addition to providing versatility, such a configuration may reduce down-time associated with changing drive motors.

The drive motors 251, 551 can have any configuration desired. In at least one example, the drive motors can be hydraulic motors, such as Geroler, Geroter, and/or valve in star (VIS) type hydraulic motors.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A modular rotary drill head, comprising:

a base for securing the modular rotary drill head to a sled assembly of a drill rig;

a housing movably coupled to said base, said housing including a first portion and an opposing second portion;

a plurality of motor assemblies removably secured to an exterior surface of said first portion of said housing;

a drive shaft positioned at least partially within said housing, said drive shaft being secured to said housing by at least one radial bearing, at least one upper axial bearing restricting movement in a first axial direction, and at least one lower axial bearing restricting movement in a second axial direction opposite said first axial direction thereby allowing said drive shaft to withstand high axial forces;

a gear wheel secured to said drive shaft; and a plurality of removable pinions securing said plurality of motor assemblies directly to said gear wheel, said plurality of removable pinions being removably secured to said second portion of said housing.

2. The modular rotary drill head as recited in claim 1, wherein said at least one upper axial bearing comprises a roller bearing.

3. The modular rotary drill head as recited in claim 1, wherein said at least one radial bearing comprises a needle bearing.

4. The modular rotary drill head as recited in claim 1, wherein said at least one upper axial bearing comprises a roller bearing and said at least one lower axial bearing comprises a roller bearing.

5. The modular rotary drill head as recited in claim 1, wherein said at least one radial bearing comprises an upper radial bearing and a lower radial bearing.

6. The modular rotary drill head as recited in claim 1, further comprising a float system that allows said housing to translate relative to said base to allow threading or un-threading of a drill string component to said drive shaft.

7. A modular rotary drill head, comprising:

a base for securing the modular rotary drill head to a sled assembly of a drill rig;

a housing movably coupled to said base, said housing including a first portion and an opposing second portion;

a plurality of motor assemblies removably secured to one or more exterior surfaces of one or more of said first portion or said second portion of said housing;

a drive shaft rotatably secured at least partially within said housing, said drive shaft having a first end extending outward of said first portion of said housing and an opposing second end extending outward of said second portion of said housing;

one or more axial bearings supporting said drive shaft within said housing thereby allowing said drive shaft to withstand high axial forces;

a gear wheel secured to said drive shaft;

a plurality of removable pinions securing said plurality of motor assemblies directly to said gear wheel;

a first flange rotatably coupled to said first end of said drive shaft, said first flange extending radially outward from said drive shaft; and a second flange rotatably coupled to said second end of said drive shaft, said second flange extending radially outward from said drive shaft;

wherein said first flange and said second flange are each adapted to secure a drilling component to said drive shaft.

8. The modular rotary drill head as recited in claim 7, wherein said first flange is adapted to be selectively coupled directly to a drilling component selected from the group consisting of a flushing head, a preventer, a chuck, an ejection bell, and a drill string.

9. The modular rotary drill head as recited in claim 7, wherein said second flange is adapted to be selectively coupled directly to a drilling component selected from the group consisting of a central flushing head, packing box, and a RC flushing head.

10. The modular rotary drill head as recited in claim 7, wherein said drive shaft is hollow and has an inner diameter of 12 cm.

11. The modular rotary drill head as recited in claim 8, further comprising a float system that allows said housing to translate relative to said base to allow threading or un-threading of a drill string component to one or more of said first flange and said second flange.

12. The modular rotary drill head as recited in claim 11, further comprising at least one radial bearing securing said drive shaft secured to said housing.

13. A modular rotary drill head, comprising:

a base for securing the modular rotary drill head to a sled assembly of a drill rig;

a housing movably coupled to said base, said housing having a first portion and an opposing second portion;

a drive shaft rotatably secured at least partially within said housing via one or more drive shaft bearings, said drive shaft having a first end and an opposing second end, wherein each of said first and second ends are adapted to rotatably couple to a drilling component;

a gear wheel secured around said drive shaft;

a plurality of removable pinions positioned within said housing between said first and second portions, wherein each pinion of said plurality of removable pinions includes a first side and an opposing second side;

a plurality of motor assemblies removably secured directly to an exterior surface of said first portion of said housing, wherein each motor assembly of said plurality of motor assemblies is secured directly to said gear wheel by a removable pinion of said plurality of removable pinions;

one or more radial pinion bearing assemblies securing said first side of each pinion to said second portion of said housing, wherein said second side of each pinion is secured to and supported by a portion of a motor assembly of said plurality of motor assemblies, said portion of said motor assembly extending into said housing; and one or more lubrication pumps configured to automatically lubricate said one or more radial pinion bearing assemblies.

14. The modular rotary drill head as recited in claim 13, further comprising one or more lubrication conduits extending from said one or more lubrication pumps to each of said one or more radial pinion bearing assemblies.

15. The modular rotary drill head as recited in claim 13, wherein said plurality of motor assemblies comprises three motor assemblies and said plurality of removable pinions comprises three removable pinions.

16. The modular rotary drill head as recited in claim 13, further comprising a float system that allows said housing to translate relative to said base to allow threading or un-threading of a drill string component to said drive shaft.

17. The modular rotary drill head as recited in claim 16, wherein said one or more drive shaft bearings comprise at least one radial bearing and at least one axial bearing.

18. A modular rotary drill head, comprising:

a base for securing the modular rotary drill head to a sled assembly of a drill rig;

a housing movably coupled to said base;

a drive shaft rotatably secured at least partially within said housing via one or more bearings, said drive shaft having a first end and an opposing second end, wherein each of said first and second ends are adapted to rotatably couple to a drilling component;

a gear wheel secured around said drive shaft;

at least three valve in star hydraulic motors removably secured directly to an exterior surface of said housing; and a plurality of removable pinions positioned entirely within said housing, said plurality of removable pinions securing said at least three valve in star hydraulic motors directly to said gear wheel;

wherein the modular rotary drill head is capable for use in reverse-circulation drilling and double head drilling.

19. The modular rotary drill head as recited in claim 18, wherein said one or more bearings comprise at least one radial bearing and at least one axial bearing securing said drive shaft secured to said housing.

20. The modular rotary drill head as recited in claim 19, further comprising a float system that allows said housing to translate relative to said base to allow for threading or un-threading of a drill string component to said drive shaft.

* * * * *